US009511927B1

(12) United States Patent
Schumacher

(10) Patent No.: US 9,511,927 B1
(45) Date of Patent: Dec. 6, 2016

(54) TIME-DELAY ACTUATOR ASSEMBLY FOR AN AEROSOL CONTAINER

(71) Applicant: S.C. Johnson & Son, Inc., Racine, WI (US)

(72) Inventor: Donald J. Schumacher, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 2 days.

(21) Appl. No.: 14/739,369

(22) Filed: Jun. 15, 2015

Related U.S. Application Data

(60) Provisional application No. 62/013,018, filed on Jun. 17, 2014.

(51) Int. Cl.
*B65D 83/26* (2006.01)

(52) U.S. Cl.
CPC ..... *B65D 83/262* (2013.01)

(58) Field of Classification Search
CPC ..... B65D 83/262
USPC ..... 222/1, 649, 402.1, 402.14, 518
See application file for complete search history.

(56) References Cited

U.S. PATENT DOCUMENTS 3,804,302 A 4/1974 Yamada et al.
4,186,853 A 2/1980 White
4,381,065 A 4/1983 Hayes
4,428,509 A 1/1984 Emerson et al.
4,941,600 A 7/1990 Berriochoa et al.
5,503,303 A 4/1996 LaWare et al.
5,702,036 A 12/1997 Ferrara, Jr.
5,791,524 A 8/1998 Demarest
6,062,432 A 5/2000 Estrada
6,241,131 B1 6/2001 Katsuda et al.
6,926,172 B2 8/2005 Jaworski et al.
6,971,560 B1 12/2005 Healy et al.
6,978,947 B2 12/2005 Jin
7,195,139 B2 3/2007 Jaworski
7,213,728 B2 5/2007 Kutsch et al.
2002/0130146 A1* 9/2002 Borut ..... A61L 9/12 222/645
2004/0074929 A1* 4/2004 Yquel ..... B65D 83/565 222/402.1
2005/0252928 A1* 11/2005 Healy ..... B65D 83/24 222/1
2007/0181609 A1* 8/2007 Rymer ..... B65D 83/205 222/402.1
2008/0277411 A1* 11/2008 Beland ..... B65D 83/205 222/52

* cited by examiner

*Primary Examiner* — Donnell Long

(57) ABSTRACT

A time-delay actuator assembly is disclosed that can dispense chemicals from an aerosol container. The time-delay actuator assembly is mountable to the aerosol container and includes an inner cap, an outer cap adjacent the inner cap, a retainer coupled to the outer cap, a biasing member, and a time-delay member that resists essentially axial relative movement between the inner cap and the outer cap when the outer cap has been rotated to align a guide member with an essentially axial section of a guide track, thereby causing a time delay between when the guide member is aligned with the essentially axial section and when chemicals are dispensed from the aerosol container.

20 Claims, 10 Drawing Sheets

TIME-DELAY ACTUATOR ASSEMBLY FOR AN AEROSOL CONTAINER

CROSS-REFERENCE TO RELATED APPLICATIONS

This application claims priority based on U.S. provisional application 62/013,018 filed Jun. 17, 2014.

STATEMENT REGARDING FEDERALLY SPONSORED RESEARCH/DEVELOPMENT

Not applicable

BACKGROUND OF THE INVENTION

The present invention relates to aerosol dispensing devices, and in particular to actuator assemblies that provide a regulated time delay between the initial activation of the devices and the actual release of the aerosol contents to the ambient environment.

Aerosol containers dispense a variety of ingredients. One or more chemicals to be dispensed are usually mixed in a solvent and, in any event, typically are mixed with a propellant. Typical propellants are compressed air or other compressed gases, carbon dioxide, a selected hydrocarbon gas, or mixtures of hydrocarbon gases, such as a propane/butane mix. For convenience, materials being dispensed will be referred to herein merely as "chemical(s)," regardless of their chemical nature or intended function. Without limitation, chemicals can include actives such as insect control agents (e.g., a repellent, insecticide, or growth regulator), fragrances, sanitizers, cleaners, waxes or other surface treatments, and/or deodorizers.

The active/propellant mixture is stored under pressure in the aerosol container. The mixture is then sprayed out of the container most often by pushing down or sideways on an activator button at the top of the container that controls a release valve mounted at the top end of the container. The sprayed active may exit in an emulsion state, single phase, multiple phase, and/or be partially gaseous. The aerosol container contents can thus be released via manual pressure (for as long as such manual pressure is provided).

Alternatively, the control valve can be switched to an "on" position, such that essentially the entire contents of the can are automatically dispersed in a single continuous, albeit elongated, burst (e.g., total release foggers), or by intermediate spaced bursts (e.g., automatic dosing systems).

U.S. Pat. No. 6,971,560 discloses a system for providing a time delay between the initial activation and the actual release of the contents to the ambient. This time delay provides the operator time to leave the dispense area to avoid being exposed to the chemicals. This is especially desirable when the active being dispensed is an insecticidal fumigant. However, the system relies on an interaction between a cap and an associated stem, where the structure is an external structure that might be disturbed during shipping or otherwise prior to use.

U.S. Pat. No. 6,926,172 discloses a total release type automated dispensing system for an aerosol container that activates upon rotation of an exterior cap. However, the structure does not have a desirable time delay feature and, in any event, has a somewhat complex construction that may be difficult for the operator to use.

Hence, a need remains to provide improved, inexpensive, and reliable time delay systems for dispensing chemicals from an aerosol container.

SUMMARY OF THE INVENTION

In one aspect, the invention provides a time-delay actuator assembly suitable for dispensing a chemical to ambient environment from an aerosol container having a release valve. The time-delay actuator assembly comprises an inner cap that defines an opening and that is adapted to mount on the aerosol container. An outer cap is adjacent the inner cap. A retainer is coupled to the outer cap and extends through the opening in the inner cap. An actuator extends from at least one of the outer cap and the retainer, and is adapted to selectively engage the release valve.

A biasing member urges the actuator toward the release valve. A time-delay member resists essentially axial relative movement between the inner cap and the outer cap. A guide track is formed on one of the inner cap and the outer cap, and has a circumferential section and an essentially axial section. A guide member is formed on the other of the inner cap and the outer cap, and is adapted to engage the guide track.

Rotating the outer cap relative to the inner cap moves the guide member along the circumferential section of the guide track. When the guide member is aligned with the essentially axial section of the guide track the biasing member urges the actuator toward the release valve in a manner such that the resistance of the time-delay member to essentially axial movement between the inner cap and the outer cap causes a time delay between when the guide member is first aligned with the axial section and when the actuator engages the release valve.

In another aspect the invention provides a method for dispensing a chemical from an aerosol container. The method comprises the steps of obtaining an aerosol container containing a chemical and having a release valve and a time-delay actuator assembly mounted thereon. The time-delay actuator assembly comprises an inner cap that defines an opening and that is adapted to mount on the aerosol container. The time-delay actuator assembly further comprises an outer cap that is adjacent the inner cap. A retainer is coupled to the outer cap and extends through the opening in the inner cap. An actuator extends from at least one of the outer cap and the retainer. A biasing member urges the actuator toward the release valve, and a time-delay member resists essentially axial relative movement between the inner cap and the outer cap. A guide track is formed in one of the inner cap and the outer cap, and has a circumferential section and an essentially axial section. A guide member is formed in the other one of the inner cap and the outer cap and is adapted to engage the guide track. The method further comprises rotating the outer cap relative to the inner cap from a storage position, at which the actuator is spaced apart from the release valve, toward a time-delay position by moving the guide member along the circumferential section of the guide track. The guide member is then aligned with the essentially axial section of the guide track such that the biasing member urges the actuator toward the release valve against resistance of the time-delay member during a time delay, and such that the actuator engages the release valve after the time delay causing the chemical to be dispensed from the aerosol container.

In use a consumer will rotate the outer cap and then will have a specified period, such as about thirty seconds, to leave the area before spraying starts. The structure is relatively inexpensive to produce and reliable. Further, because the elements of the time delay feature are internal, the elements are resistant to being disturbed during shipping or the like.

The foregoing and other aspects of the invention will become apparent from the following description. In the following description reference is made to the accompanying drawings that form a part thereof, and in which there is shown by way of illustration preferred embodiments of the invention. Such embodiments do not represent the full scope of the invention. Reference should therefore be made to the claims herein for interpreting the scope of the invention. The use of relative/directional terms (e.g., upper, lower, top, bottom, etc.) are used for convenience in describing the example embodiments, and in no way limit the scope of the invention.

DETAILED DESCRIPTION

Figure 1:
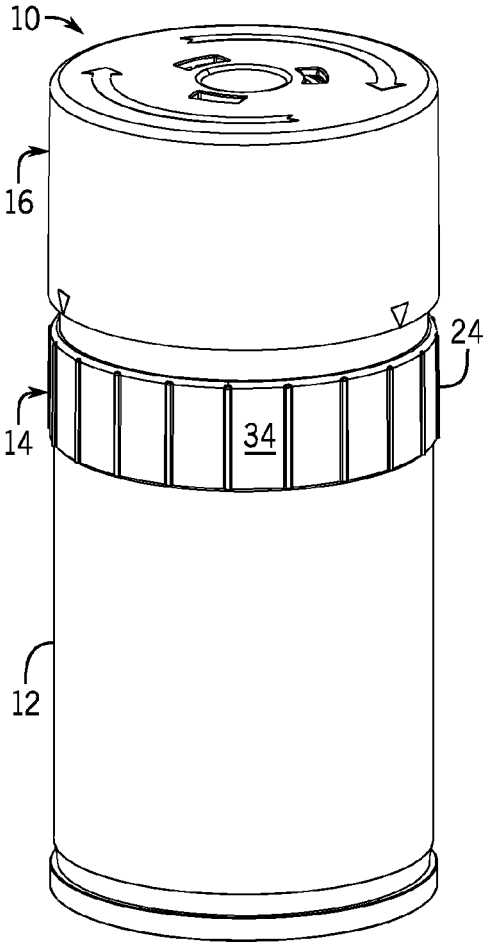
FIG. 1 is a top, frontal perspective view of an example time-delay actuator assembly of the present invention.
Figure 2:
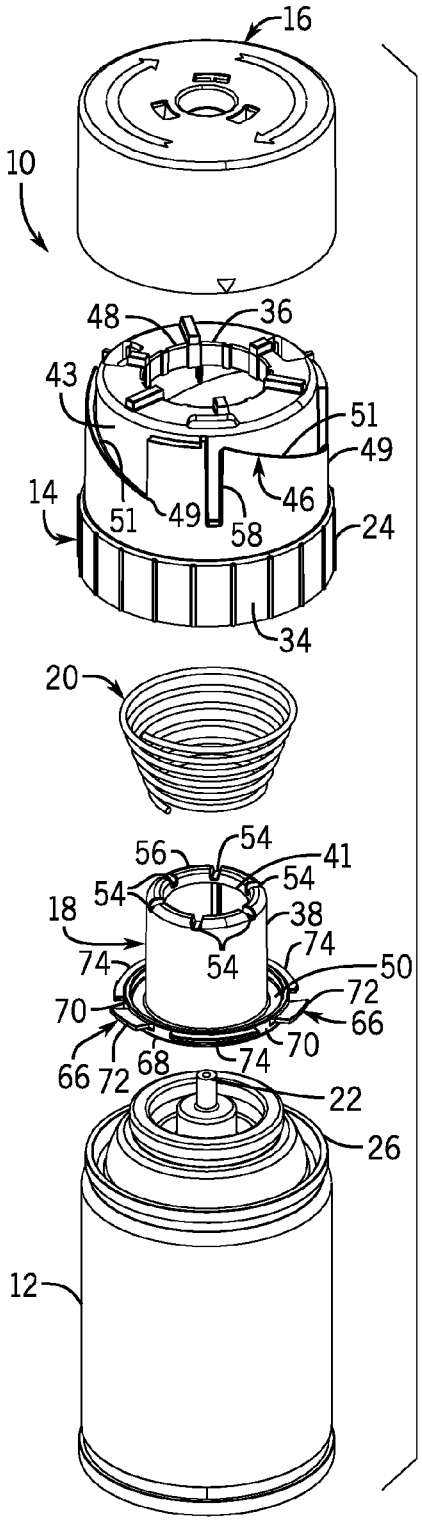
FIG. 2 is an exploded view thereof.

A first example time-delay actuator assembly (10), which is shown configured to dispense a chemical (e.g., insecticide) to ambient environment from an aerosol container (12), is illustrated in FIGS. 1-11. As illustrated in FIG. 2, the example time-delay actuator assembly (10) includes four main components, specifically, an inner cap (14), an outer cap (16), a retainer (18), and a biasing member (20). Rotation of the outer cap (16) relative to the inner cap (14) increases the potential energy of the biasing member (20) that is ultimately used to urge the retainer (18) toward a release valve (22) of the aerosol container (12), thereby dispensing the chemical. However, the example time-delay actuator assembly (10) includes time-delay members that resist axial movement between the inner cap (14) and the outer cap (16) to establish a time delay before the chemical is dispensed from the aerosol container (12), even when one tries to start the dispensing.

Figure 4:
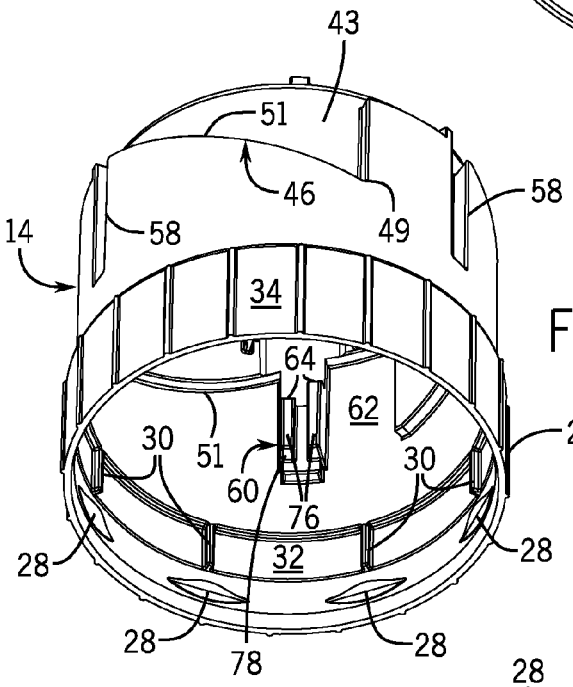
FIG. 4 is a bottom perspective view of an example inner cap.

The example inner cap (14) includes a collar (24) that is adapted to mount on a rim (26) of the aerosol container (12). As illustrated in FIG. 4, the collar (24) includes a plurality of lips (28) and longitudinal ribs (30) circumferentially spaced about an inside surface (32) of the collar (24). The rim (26) is captured between the plurality of lips (28) and longitudinal ribs (30) when the inner cap (14) is secured to the aerosol container (12). In the embodiment shown in FIG. 4, each of the plurality of lips (28) is aligned with each of the longitudinal ribs (30). However, each of the plurality of lips (28) may be circumferentially spaced from each of the longitudinal ribs (30) along the inside surface (32) of the collar (24), so long as the rim (26) is captured there between to secure the inner cap (14) to the aerosol container (12). The collar (24) also includes a contoured grip (34) to aid relative rotation of the inner cap (14) and the outer cap (16).

Figure 3:
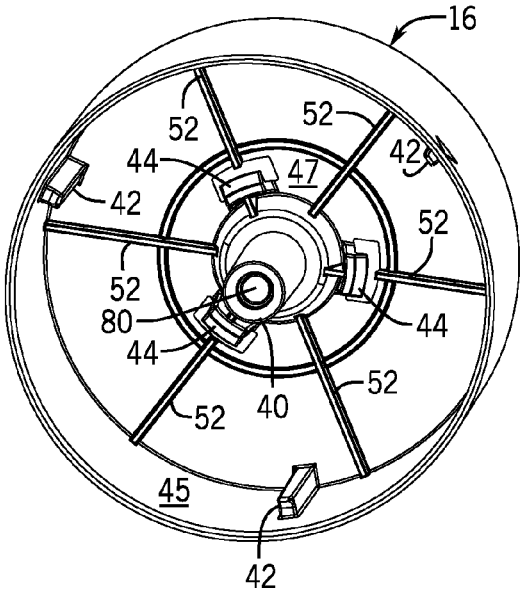
FIG. 3 is a bottom perspective view of an example outer cap.
Figure 5:
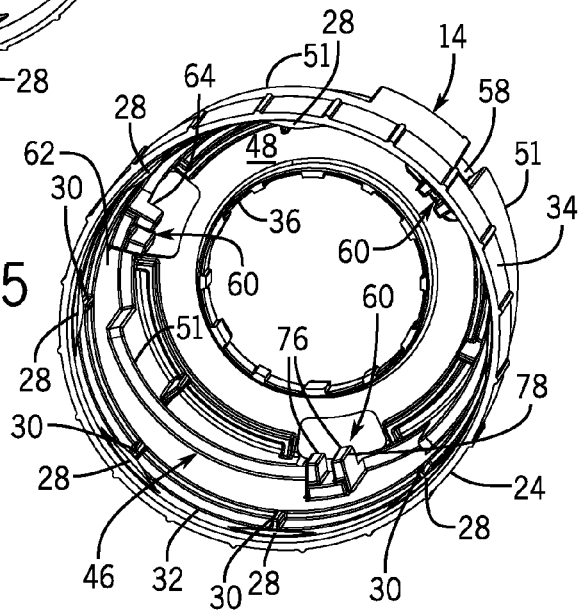
FIG. 5 is another bottom perspective view of the example inner cap.
Figure 9:
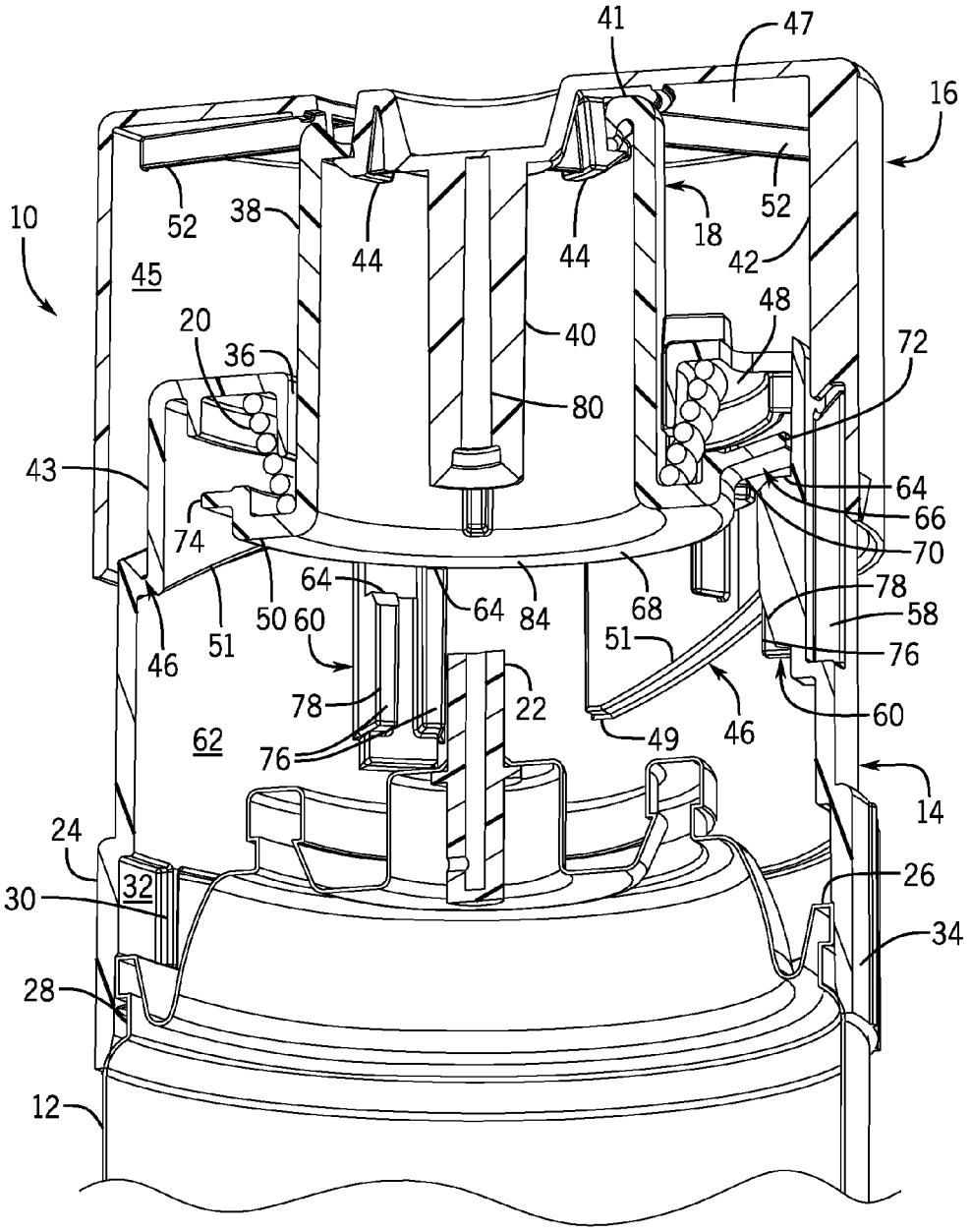
FIG. 9 is a partial axial section view taken along line 9-9 of FIG. 8 showing the example time-delay actuator assembly in the FIG. 8 position.
Figure 10:
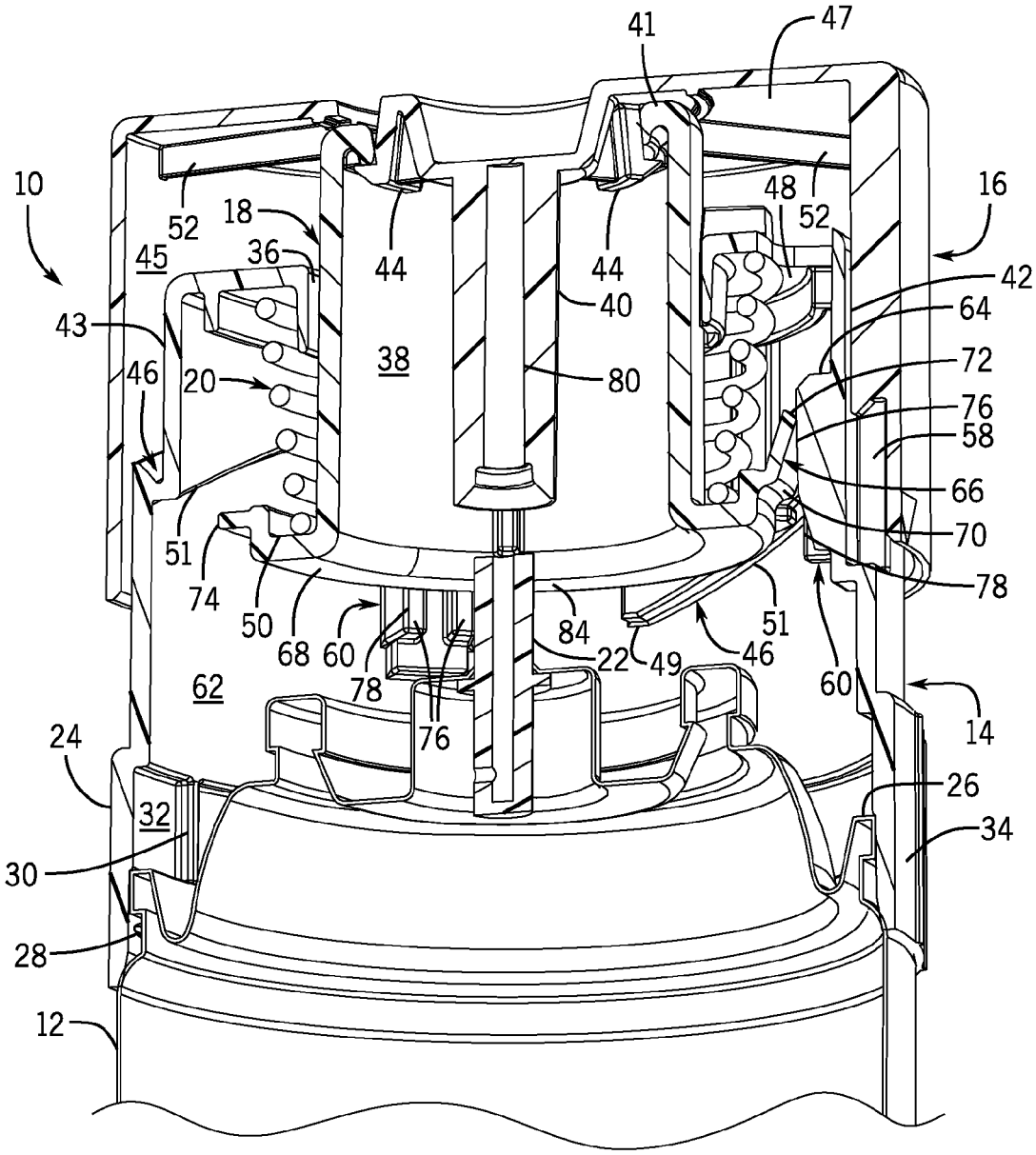
FIG. 10 is a partial axial section view showing an example time-delay member resisting axial movement between the example inner cap and the example outer cap.
Figure 11:
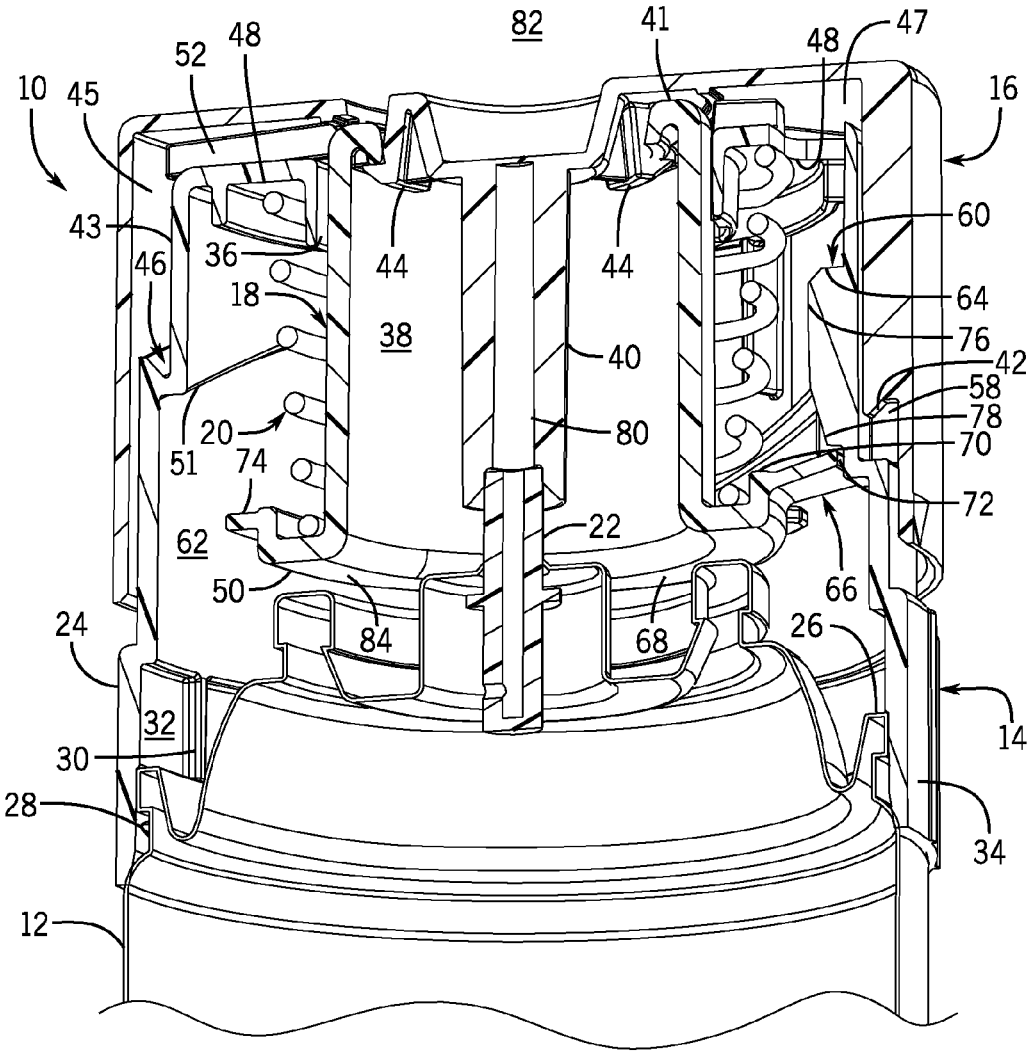
FIG. 11 is a partial axial section view showing the example actuator engaging the release valve of an aerosol container.

Prior to mounting the inner cap (14) to the aerosol container (12), and as best shown in FIGS. 2, 3, and 5, the retainer (18) and the outer cap (16) are secured together to capture the biasing member (20) between the retainer (18) and the inner cap (14). The inner cap (14) defines an opening (36) through which a cylindrical portion (38) of the retainer (18) extends. An actuator (40) integrally formed in the outer cap (16) then extends into the cylindrical portion (38) of the retainer (18), as best shown in FIGS. 9-11.

To secure the retainer (18) to the outer cap (16), a lip (41) of the cylindrical portion (38) engages several finger clips (44) extending from an inner axial face (47) of the outer cap (16). The finger clips (44) resiliently flex to engage the lip (41) of the retainer (18), thus capturing the biasing member (20) (e.g., a compression spring) seated between an upper flange (48) defined by the inner cap (14) and a lower flange (50) defined by the retainer (18) (see, e.g., FIGS. 9-11). In addition, a series of radially extending ridges (52) formed in the inner axial face (47) of the outer cap (16) engage mating notches (54) formed in a top face (56) of the retainer (18) to rotatably interlock the outer cap (16) and the retainer (18).

With the outer cap (16) adjacent to and co-axial with the inner cap (14), the inner cap (14) is partially nested within the outer cap (16), and the time-delay actuator assembly (10) is then mounted to the aerosol container (12). With additional reference to the example embodiment shown in FIGS. 6-8, the outer cap (16) is rotatable relative to the inner cap (14) clockwise in the direction of arrow (A). The outer cap (16) includes a guide member in the form of a guide projection (42) that is integrally formed with the outer cap (16) and extends generally longitudinally along an inner surface (45) of the outer cap (16) (best shown in FIG. 3). The guide projection (42) is adapted to engage a guide track (46) that extends radially outward from and is integrally formed on an outer surface (43) of the inner cap (14). The time-delay actuator assembly (10) is illustrated in the storage position in FIG. 6. When in the storage position, the actuator (40) is spaced apart from the release valve (22) of the aerosol container (12) to inhibit the contents of the aerosol container (12) from being inadvertently dispensed during shipping and handling.

In the storage position, the guide projection (42) is positioned at a lower end (49) of a circumferential section (51) of the guide track (46). As noted above, the engagement between the guide projection (42) and the lower end (49) inhibits the outer cap (16) from moving axially downward toward the inner cap (14) and thus inhibits the actuator (40) from engaging the release valve (22) to dispense the chemical from the aerosol container (12).

Figures 6, 7, 8:
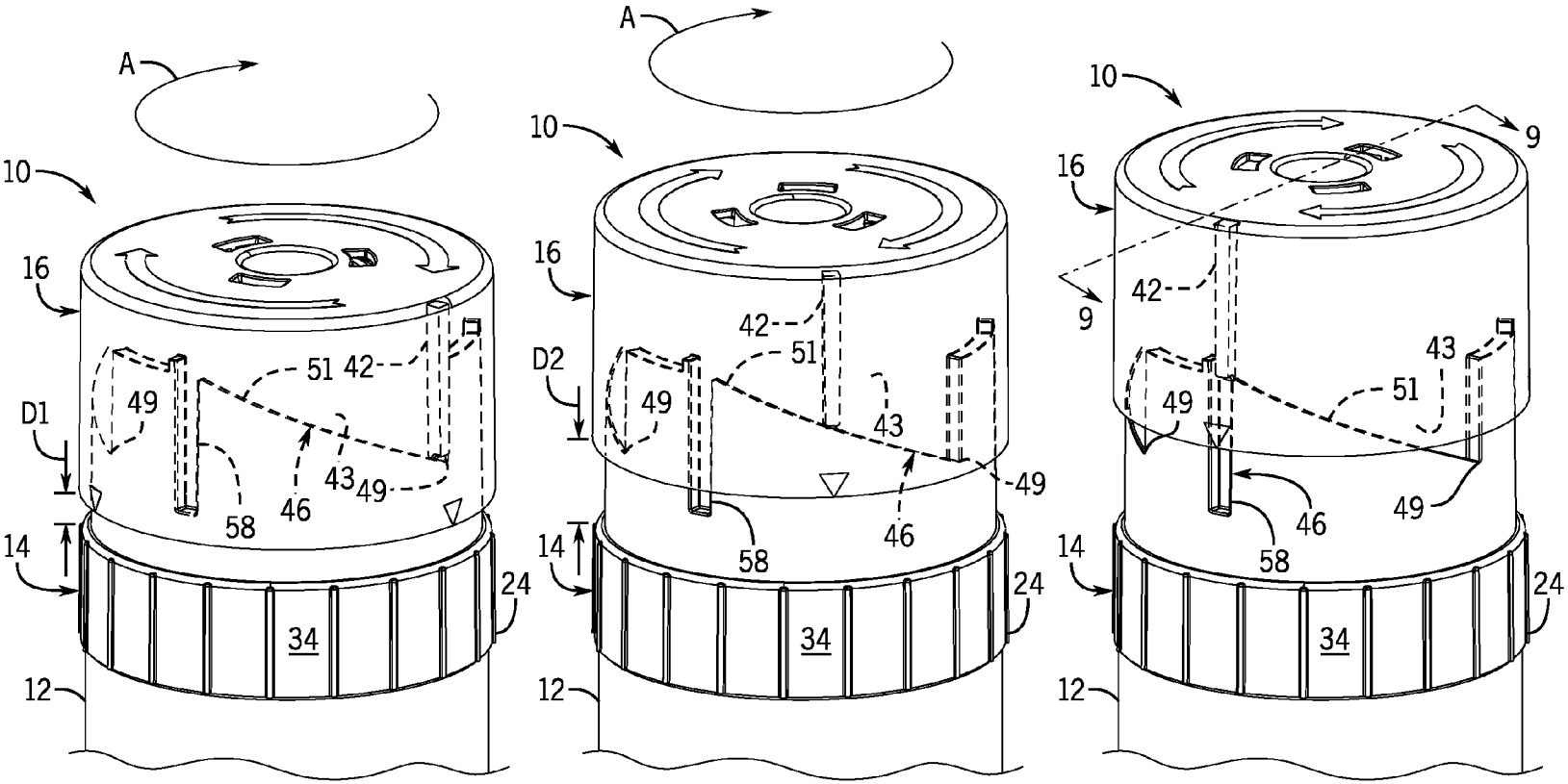
FIG. 6 is a partial perspective view showing the example time-delay actuator assembly in the storage position.
FIG. 7 is a partial perspective view showing the example outer cap partially rotated relative to the inner cap.
FIG. 8 is a partial perspective view showing the example time-delay actuator assembly in an about to be activated position.

With reference to FIG. 7, rotating the outer cap (16) relative to the inner cap (14) in the direction of arrow (A) results in the guide projection (42) riding upward along the inclined surface of the circumferential section (51) of the guide track (46). Thus, upon rotation, the outer cap (16) moves upward along the inclined surface of the circumferential section (51) and axially away from the inner cap (14), as shown by an increase in distance between D1 and D2 illustrated in FIGS. 6 and 7, respectively. Essentially simultaneously, the retainer (18) secured to the outer cap (16) further compresses the biasing member (20) (increasing the potential energy (i.e., urging) of the biasing member (20)) as the guide projection (42) slides upward along the guide track (46). More specifically, as the guide projection (42) slides upward along the guide track (46), the lower flange (50) of the retainer (18) also moves upward to further compress the biasing member (20) against the upper flange 48 of the inner cap (14).

While the circumferential section (51) is illustrated as a general smooth/continuous ramp, one skilled in the art will appreciate that the circumferential section (51) may be of various configurations, such as stepped, saw toothed, curved, and the like. Regardless of the configuration of the circumferential section (51), when the outer cap (16) is fully rotated, as illustrated in FIG. 8, the time-delay actuator assembly (10) is in the about to be actuated position, and the guide projection (42) is aligned with an axial section (58) of the guide track (46). Once in the actuated position, the biasing member (20) is allowed to urge the outer cap (16) axially downward toward the inner cap (14) when the guide projection (42) is received by the axial section (58), as illustrated in FIG. 11.

With continued reference to FIGS. 2-5 and additional reference to FIGS. 9-11, example time-delay members (e.g., first and second delay members) of the example time-delay actuator assembly (10) are described in detail. In the example embodiment, the inner cap (14) includes a first delay member in the form of rigid projections (60) that extend from an interior circumferential surface (62) of the inner cap (14). As illustrated, the projections (60) comprise three pairs of axially extending protrusions integrally formed with the inner cap (14) that are equally spaced about the circumference of the inner cap (14).

As best shown in FIG. 4, the top ends (64) of each pair of projections (60) are slightly offset in the longitudinal direction to allow more gradual engagement with a second delay member. The second delay member is in the form of resilient fingers (66) extending from the retainer (18). Specifically, three resilient fingers (66) extend radially from an end portion (68) of the retainer (18). The resilient fingers (66) are integrally formed with the lower flange (50) at a proximal end (70) and extend toward a distal end (72), defining a generally flared fin. The retainer (18) also includes three lips (74) circumferentially spaced apart and adapted to engage a radially inward face (76) of the respective the projections (60) as the guide projection (42) moves along the circumferential section (51) of the guide track (46), thereby helping center the retainer (18) during rotation.

With continued reference to FIGS. 9 and 10, the guide projections (42) are shown aligned with the mating axial sections (58) placing the time-delay actuator assembly (10) in the activated position. When the outer cap (16) and inner cap (14) are so aligned, the biasing member (20) urges the outer cap (16) and coupled retainer (18) downward (as viewed in FIGS. 9-11), such that the actuator (40) moves toward the release valve (22) of the aerosol container (12). As best shown in FIG. 10, the resilient fingers (66) flex and wipe against the projections (60) as the urging of the biasing member (20) moves the retainer (18) downward. A time delay occurs because, as in the example embodiment, the resilient fingers (66) of the retainer (18) engage, flex, and rub against the respective projections (60) (i.e., first engaging one of the pair of projections (60) and then wiping against both projections (60) due to the longitudinal offset of each pair of projections (60)).

The time delay establishes a delay between when the guide projection (42) is aligned with the axial section (58) and when the actuator (40) engages the release valve (22), thus dispensing the chemical, and that is greater than a time delay that would exist without the influence of the time-delay members. The time delay may be adjusted to any application specific period, and in some forms is between five seconds and one minute.

Turning to FIG. 11, as the retainer (18) continues to move downward, the projections (60) define a lower end (78) that may be tapered such that the resilient fingers (66) no longer engage with the projections (60) and return to their undeflected orientation. Without the engagement between the projections (60) and the fingers (66) providing axial resistance against the biasing member (20), the urging of the biasing member (20) drives the actuator (40) into operative engagement with the release valve (22) of the aerosol container (12). The operative engagement of the actuator (40) with the release valve (22) allows the chemical (or the like) to be dispensed from the aerosol container (12) through a passage (80) in the actuator (40) to ambient (82).

As one skilled in the art will appreciate, given the benefit of this disclosure, various modifications may be made to the example time-delay actuator assembly (10) described. For example, the guide member (42) may be formed in the outer cap (16) and the guide track (46) may be formed in the inner cap (14). Similarly, the rigid member (60) may be formed in the retainer (18) and the resilient member (66) may be formed in the inner cap (14). Alternatively, both the first delay member and the second delay member may be, for example, resilient such that each flexes somewhat during engagement to establish a time delay. Additionally, or alternatively, the quantity of rigid members (60) and resilient members (66) may vary to provide a sufficient time delay.

Moreover, the actuator (40) may be integral with the retainer (18) such that the actuator (40) moves essentially axially in connection with the retainer (18) to selectively engage the release valve (22) of the aerosol container (12). The retainer (18) may also be integral with the outer cap (16). And, the biasing member (20) (e.g., an extension spring) may be coupled to a bottom face (84) of the retainer (18) and to one of the aerosol container (12) or the inner cap (14), such that the biasing member (20) is extended as the outer cap (16) is rotated relative to the inner cap (14).

The inner cap (14), the outer cap (16), and the retainer (18) may be molded from plastic or made from any other suitable material given the specific application requirements. For example, where extreme conditions exist and/or reusability is desired, various components may be made of metals and/or composites. In one form, the biasing member (20) is made of metal (e.g., a metallic compression spring), however, the biasing member (20) may have various other form factors incorporating a variety of materials (e.g., a resilient rubber cylindrical sleeve, one or more Belleville washers, and the like).

Several additional example embodiments of delay members are illustrated in FIGS. 12-19. While the inner cap (14) shown, for example, in FIG. 2 includes a guide member (e.g., a guide track (46)) allowing for activation of the time delay to occur with relative rotation of the outer cap (16) in only one direction, the guide track (200) illustrated in FIGS. 12-18 is configured to allow relative rotation in either direction (e.g., clockwise and counterclockwise) to trigger the time delay. Specifically, the guide tracks (200) include a circumferential section (202) defining a valley (204) between peaks (206) formed at the top ends of each circumferential section (202) adjacent an axial section (300, 400, 500, 600, 700, 800, 900, 952).

The alternative embodiments illustrated in FIGS. 12-19 are generally configured to interact with the aerosol container (12), retainer (18), biasing member (20), and outer cap (16) as shown and illustrated. However, the retainer (18) need not include a delay member (e.g., resilient fingers (66)). Instead, or in addition, the outer cap (16) generally includes one or more time-delay members (e.g., a pair of guide projections (42) integrally formed with the outer cap (16) and spaced one hundred and eighty degrees apart) that engage one or more time-delay members formed in the axial section of the guide tracks (200), as will be described below.

Figure 12:
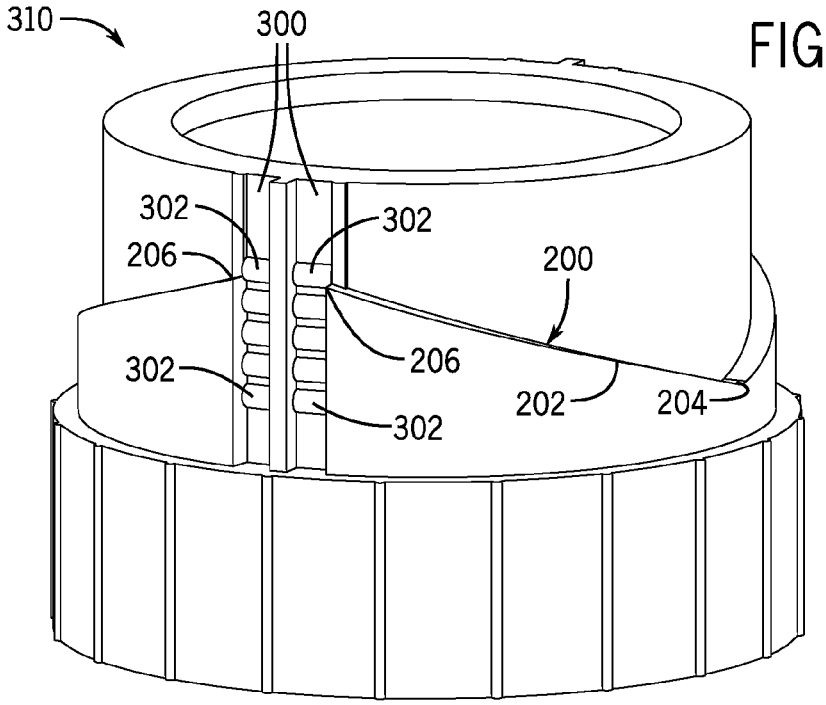
FIG. 12 is a perspective view of an alternative example inner cap including a plurality of longitudinally spaced contours for engaging guide projections to cause a time delay.

With specific reference to FIG. 12, an inner cap (310) is shown having axial sections (300) including a plurality of longitudinally spaced contours in the form of arcuate bumps (302) that are configured to engage respective guide projections (42) formed on the outer cap (16). As a result, the engagement and resistance between the arcuate bumps (302) and the guide projections (42) inhibits the urging of the biasing member (20), thereby causing a time delay.

Figure 13:
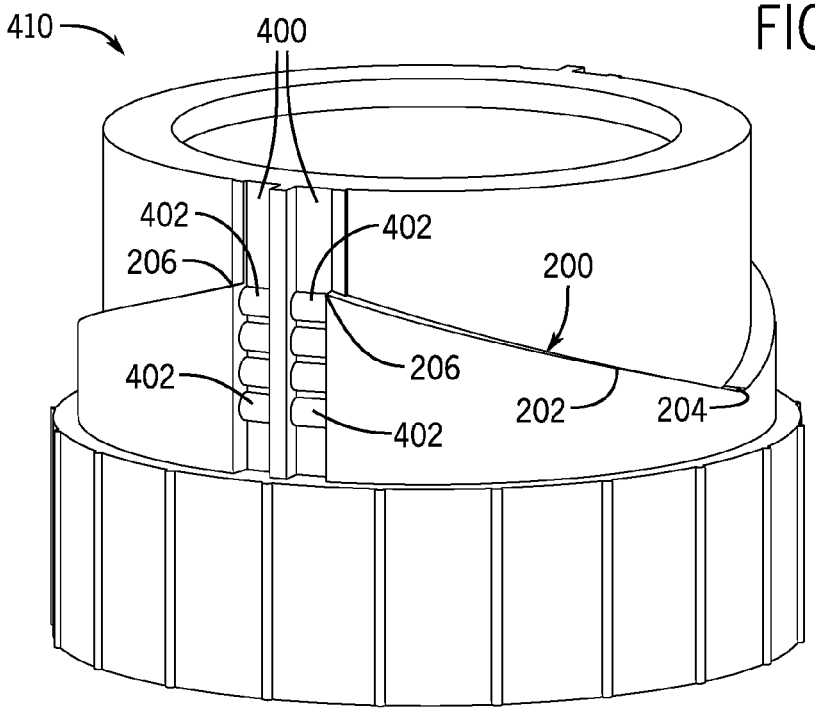
FIG. 13 is a perspective view of another alternative example inner cap including a plurality of longitudinally spaced contours for engaging guide projections to cause a time delay.

Turning to FIG. 13, an inner cap (410) includes similar arcuate bumps (402) that are formed on the axial sections (400) to rub against respective guide projections (42) formed on the outer cap (16). However, the placement of the arcuate bumps (402) along the axial section (400) slightly below the peaks (206) of the guide tracks (200) results in the outer cap (16) moving slightly downward before the guide projections (42) engage the arcuate bumps (402) to establish a time delay.

Figure 14:
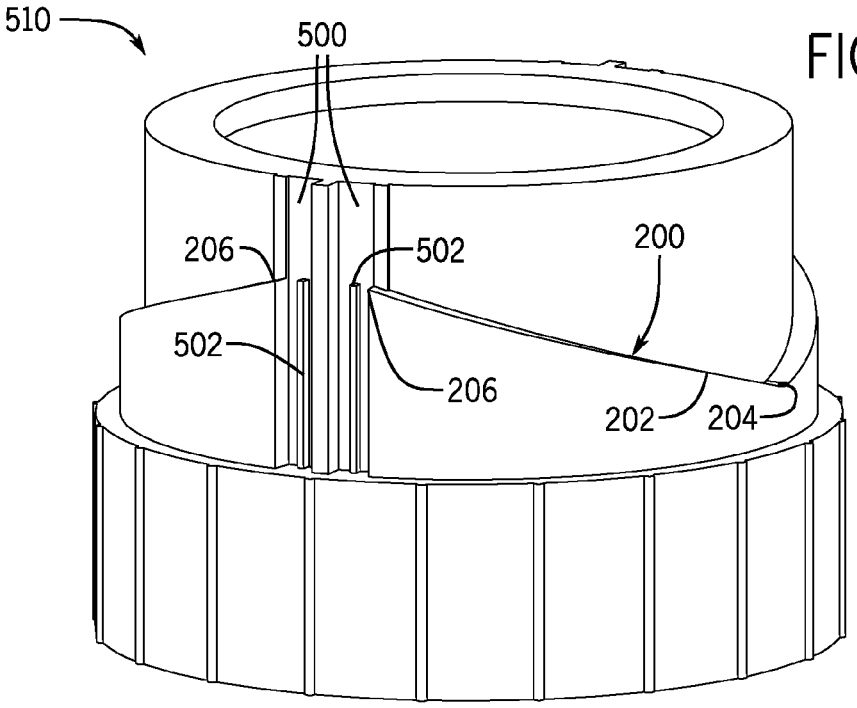
FIG. 14 is a perspective view of another alternative example inner cap including a longitudinal rib for engaging guide projections to cause a time delay.

Another alternative arrangement is illustrated in FIG. 14. In the illustrated configuration, an inner cap (510) includes an axial section (500) having a longitudinal rib (502) extending along the axial section (500). When the guide projection (42) of the outer cap (16) is aligned with the axial section (500), the guide projection (42) frictionally rubs against the longitudinal rib (502), providing a delay as the biasing member (20) urges the outer cap (16) toward the inner cap (510).

Figure 15:
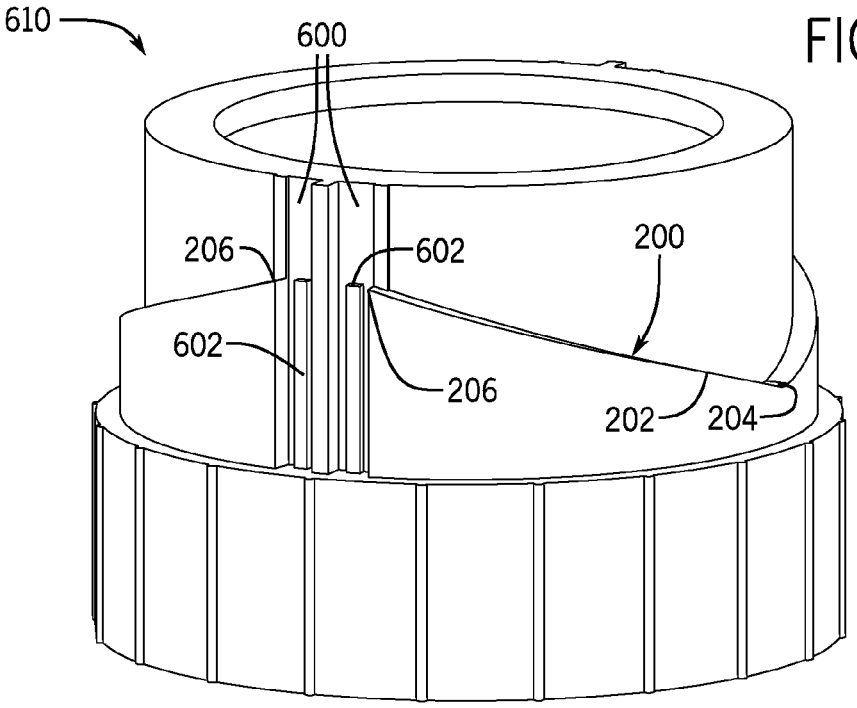
FIG. 15 is a perspective view of another alternative example inner cap including a thick longitudinal rib for engaging guide projections to cause a time delay.

A similar arrangement is shown in FIG. 15 with an inner cap (610) having a slightly thicker longitudinal rib (602) formed within an axial section (600). The thicker longitudinal rib (602) may provide a larger surface area for the guide projection (42) to engage, thereby providing a longer time delay in comparison to the narrower longitudinal rib (502) illustrated in FIG. 14.

Figure 16:
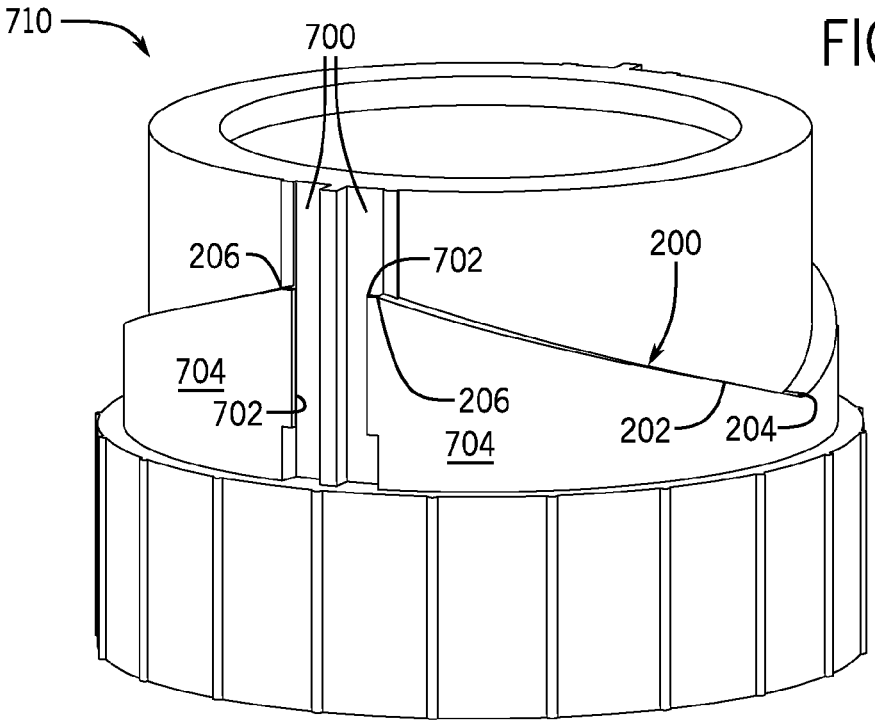
FIG. 16 is a perspective view of an alternative example inner cap including a ledge for engaging guide projections to cause a time delay.

Turning next to FIG. 16, an axial section (700) of the inner cap (710) is shown having a ledge (702) extending circumferentially from an exterior surface (704) of the inner cap (710) into the axial section (700). The guide projection (42) of the outer cap 16 rubs against the ledge (702) resulting in a time delay as the outer cap (16) is urged downward toward the inner cap (710) by the biasing member (20).

Figure 17:
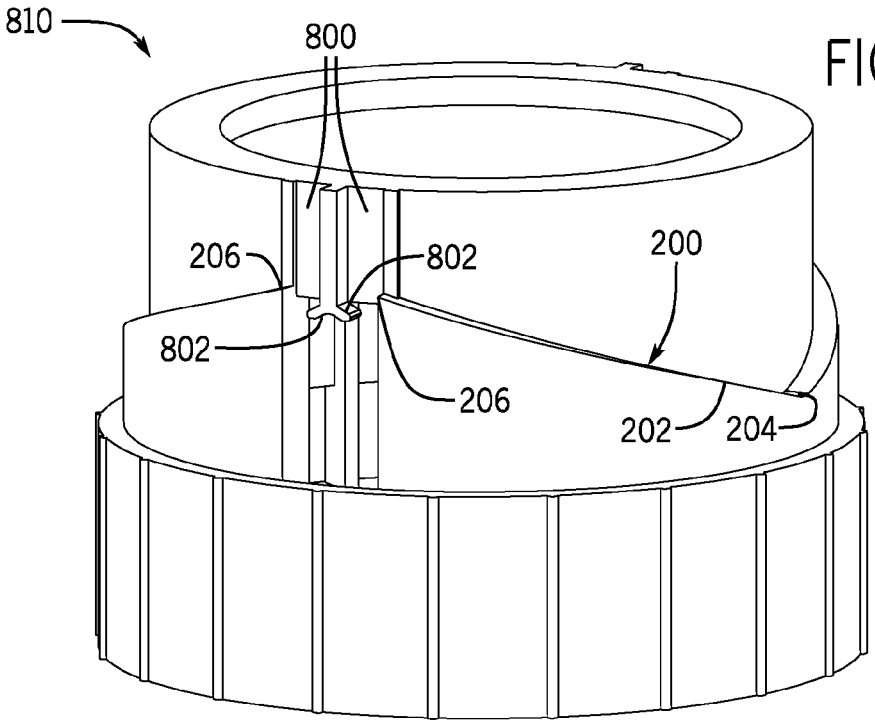
FIG. 17 is a perspective view of another alternative example inner cap including a skewed finger for engaging guide projections to cause a time delay.

A further alternative is illustrated in FIG. 17. Specifically, an inner cap (810) has an axial section (800) with a finger (802) skewed into the axial section (800). As a result, the guide projection (42) on the outer cap (16) will rub against and flex the finger (802), thereby causing a time delay as the outer cap (16) is biased downward toward the inner cap (810) by the biasing member (20).

Figure 18:
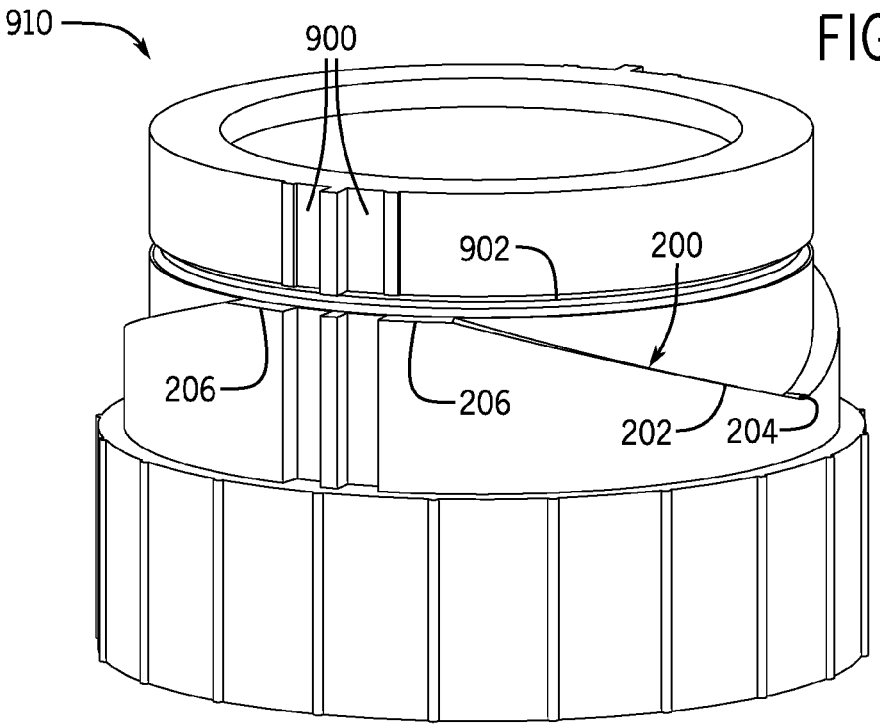
FIG. 18 is a perspective view of an alternative example inner cap including an o-ring seated in an annular recess for engaging guide projections to cause a time delay.

The alternative inner cap (910) illustrated in FIG. 18 includes an annular recess (902) passing through an axial section (900) into which an o-ring (not shown) is seated. As a result, aligning the guide projection (42) of the outer cap (16) with the axial section (900) causes the guide projection (42) to deform and rub against the o-ring, which resists the downward movement of the outer cap (16) by the biasing member (20), thereby establishing a time delay.

Figure 19:
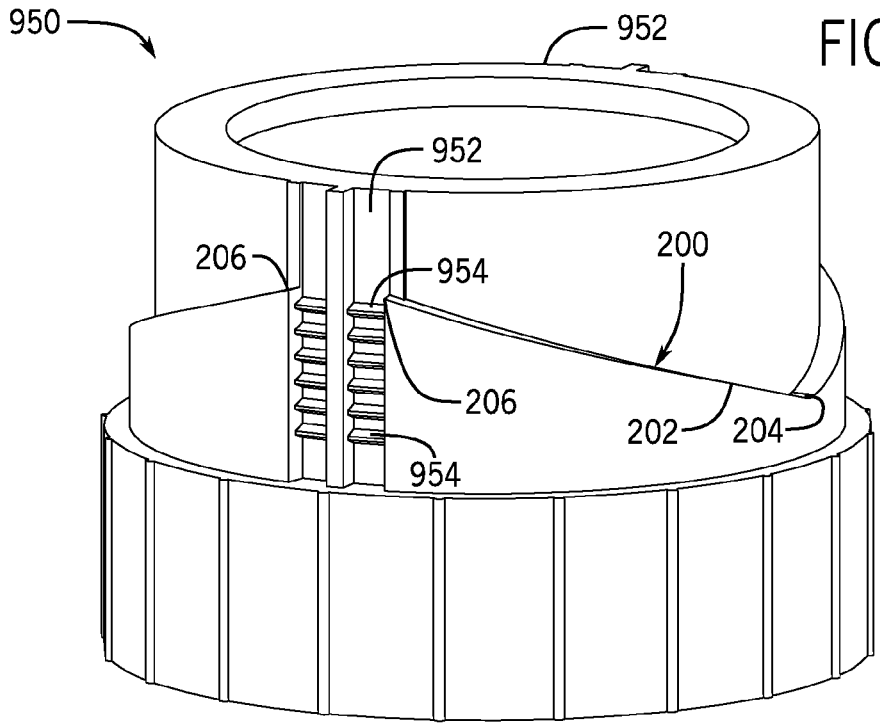
FIG. 19 is a perspective view of an alternative example inner cap including alternating skewed ramps for engaging guide projections to cause a time delay.

Another alternative inner cap (950) is illustrated in FIG. 19. In this configuration, a pair of opposed axial sections (952) work in concert with the guide projections (42) of the outer cap (16). Specifically, alternating skewed ramps (954) are longitudinally spaced in the axial sections (952) such that the biasing member (20) causes the outer cap (16) to oscillate as the guide projections (42) of the outer cap (16) slide down the alternating skewed ramps (954), ultimately allowing the outer cap (16) to "walk" down the alternating skewed ramps (954) causing the time delay.

The above description has been that of preferred embodiments of the present invention. It will occur to those that practice the art, however, that still other modifications may be made without departing from the spirit and scope of the invention. In order to advise the public of the various embodiments that may fall within the scope of the invention, the following claims are made.

INDUSTRIAL APPLICABILITY

The present invention provides actuator assemblies useful for dispensing chemicals from an aerosol container in a time-delayed fashion.

What is claimed is:

1. A time-delay actuator assembly suitable for dispensing a chemical to ambient environment from an aerosol container having a release valve, comprising:

an inner cap defining an opening and adapted to mount on the aerosol container;

an outer cap adjacent the inner cap;

a retainer coupled to the outer cap and extending through the opening in the inner cap;

an actuator extending from at least one of the outer cap and the retainer, and adapted to selectively engage the release valve;

a biasing member urging the actuator toward the release valve;

a time-delay member resisting essentially axial relative movement between the inner cap and the outer cap;

a guide track formed on one of the inner cap and the outer cap, and having a circumferential section and an essentially axial section; and a guide member formed on the other one of the inner cap and the outer cap adapted to engage the guide track;

wherein rotating the outer cap relative to the inner cap moves the guide member along the circumferential section of the guide track; and wherein when the guide member is aligned with the essentially axial section of the guide track, the biasing member urges the actuator toward the release valve in a manner such that resistance of the time-delay member to essentially axial movement between the inner cap and the outer cap causes a time delay between when the guide member is first aligned with the axial section and when the actuator engages the release valve.

2. The time-delay actuator assembly of claim 1, wherein the time-delay member comprises:

a first delay member formed on one of the inner cap and the retainer; and a second delay member formed on the other one of the inner cap and the retainer;

wherein at least one of the first delay member and the second delay member rubs against the other of the first delay member and the second delay member causing the time delay.

3. The time-delay actuator assembly of claim 2, wherein:

the first delay member is a rigid member; and the second delay member is a resilient member.

4. The time-delay actuator assembly of claim 3, wherein the resilient member extends from an end portion of the retainer and comprises a plurality of radially extending fingers integrally formed with the retainer.

5. The time-delay actuator assembly of claim 3, wherein the retainer further comprises a lip adapted to engage a radially inward face of the rigid member when the guide member moves along the circumferential section of the guide track.

6. The time-delay actuator assembly of claim 3, wherein the rigid member extends from an inner surface of the inner cap and comprises a plurality of axially extending protrusions integrally formed with the inner cap.

7. The time-delay actuator assembly of claim 1, wherein the biasing member is seated between the inner cap and the retainer.

8. The time-delay actuator assembly of claim 7, wherein:

the inner cap further comprises an upper flange;

the retainer further comprises a lower flange; and the biasing member comprises a compression spring seated between the upper flange and the lower flange.

9. The time-delay actuator assembly of claim 1, wherein:

the guide track is integrally formed on the inner cap; and the guide member is integrally formed on the outer cap.

10. The time-delay actuator assembly of claim 1, wherein the actuator is integrally formed with the outer cap.

11. The time-delay actuator assembly of claim 1, wherein the inner cap is partially nested within the outer cap.

12. The time-delay actuator assembly of claim 1, wherein the inner cap and the outer cap are co-axial.

13. The time-delay actuator assembly of claim 1, wherein:

the actuator extends from the outer cap;

the time-delay member comprises:

a projection extending from the inner cap; and a resilient finger extending from the retainer;

the guide track is formed on the inner cap; and the guide member comprises a guide projection formed on the outer cap.

14. The time-delay actuator assembly of claim 1, wherein the time-delay member is formed adjacent the essentially axial section of the guide track.

15. The time-delay actuator assembly of claim 14, wherein the time-delay member comprises at least one of arcuate bumps, a longitudinal rib, a ledge, a finger skewed into the axial section, an o-ring, and alternating skewed ramps.

16. A method for dispensing a chemical from an aerosol container, the method comprising the steps of:

obtaining an aerosol container containing a chemical and having a release valve and a time-delay actuator assembly mounted thereon, the time-delay actuator assembly comprising:

an inner cap defining an opening and adapted to mount on the aerosol container;

an outer cap adjacent the inner cap;

a retainer coupled to the outer cap and extending through the opening in the inner cap;

an actuator extending from at least one of the outer cap and the retainer;

a biasing member urging the actuator toward the release valve;

a time-delay member resisting essentially axial relative movement between the inner cap and the outer cap;

a guide track formed in one of the inner cap and the outer cap, and having a circumferential section and an essentially axial section; and a guide member formed in the other one of the inner cap and the outer cap adapted to engage the guide track;

rotating the outer cap relative to the inner cap from a storage position at which the actuator is spaced apart from the release valve toward a time-delay position by moving the guide member along the circumferential section of the guide track; and aligning the guide member with the essentially axial section of the guide track such that the biasing member urges the actuator toward the release valve against resistance of the time-delay member during a time delay, and such that the actuator engages the release valve after the time delay causing the chemical to be dispensed from the aerosol container.

17. The method of claim 16, wherein the time-delay member comprises:

a rigid member formed on one of the inner cap and the retainer; and a resilient member formed on the other one of the inner cap and the retainer;

wherein when the guide member is aligned with the essentially axial section of the guide track the biasing member urges the actuator toward the release valve such that the resilient member rubs against the rigid member causing the time delay.

18. The method of claim 16, wherein the time-delay member is formed within the axial section of the guide track.

19. The method of claim 16, wherein the time delay is between about ten seconds and about thirty seconds.

20. The method of claim 16, further comprising the steps of:

providing a first delay member formed on one of the inner cap and the retainer;

providing a second delay member formed on the other one of the inner cap and the retainer;

rubbing the at least one of the first delay member and the second delay member against the other of the first delay member and the second delay member to cause the time delay.

* * * * *